US010993472B2

(12) United States Patent
Yu et al.

(10) Patent No.: US 10,993,472 B2
(45) Date of Patent: May 4, 2021

(54) DISPOSABLE DOUBLE-CHANNEL CIGARETTE AND PREPARATION METHOD THEREOF

(71) Applicant: CHINA TOBACCO YUNNAN INDUSTRIAL CO., LTD, Kunming (CN)

(72) Inventors: Yao Yu, Kunming (CN); Jianbo Zhan, Kunming (CN); Geng Li, Kunming (CN); Zhenhua Yu, Kunming (CN); Lei Yang, Kunming (CN); Jiao Xie, Kunming (CN); Hao Wang, Kunming (CN); Juan Li, Kunming (CN); Baoshan Yue, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 0 days.

(21) Appl. No.: 16/763,230

(22) PCT Filed: May 28, 2019

(86) PCT No.: PCT/CN2019/088688

§ 371 (c)(1),
(2) Date: May 12, 2020

(87) PCT Pub. No.: WO2020/237490

PCT Pub. Date: Dec. 3, 2020

(65) Prior Publication Data

US 2020/0383382 A1 Dec. 10, 2020

(51) Int. Cl.
*A24F 42/60* (2020.01)
*A24F 42/10* (2020.01)
(Continued)

(52) U.S. Cl.
CPC ..... *A24F 42/60* (2020.01); *A24D 3/17* (2020.01); *A24F 42/10* (2020.01); *A24F 42/80* (2020.01)

(58) Field of Classification Search
CPC ..... A24F 42/60; A24F 42/10; A24F 42/80; A24D 3/17
(Continued)

(56) References Cited

U.S. PATENT DOCUMENTS 3,297,038 A * 1/1967 Homburger ..... A24D 3/061 131/337
3,773,053 A * 11/1973 Stephens, Jr. ..... A24D 1/00 131/336
(Continued)

FOREIGN PATENT DOCUMENTS

CN 103190699 A 7/2013
CN 103549657 A 2/2014
(Continued)

*Primary Examiner* — Francisco W Tschen
*Assistant Examiner* — Guy F Mongelli
(74) *Attorney, Agent, or Firm* — Bayramoglu Law Offices LLC

(57) ABSTRACT

A disposable double-channel cigarette includes a tobacco unit, a heat source unit and a filter unit; wherein the tobacco unit includes a tobacco unit channel, a suction end and an ignition end; the heat source unit includes a heat source unit channel; and the filter unit includes a filter unit channel, and the filter unit is arranged at the suction end of the tobacco unit. A pneumatic device and a tobacco component are arranged in the tobacco unit channel; an air extraction device and a fuel component are arranged in the heat source unit channel; a linkage device is arranged between the pneumatic device and the air extraction device, and the linkage device transfers power between the pneumatic device and the air extraction device. A method for preparing the disposable
(Continued)

double-channel cigarette described above is further provided.

19 Claims, 11 Drawing Sheets

(51) Int. Cl.
*A24D 3/17* (2020.01)
*A24F 42/80* (2020.01)

(58) Field of Classification Search
USPC ..... 131/328
See application file for complete search history.

(56) References Cited

U.S. PATENT DOCUMENTS 4,542,754 A * 9/1985 Cantrell ..... A24D 3/043 131/336
4,646,762 A * 3/1987 Riehl ..... A24D 3/043 131/336
4,989,619 A * 2/1991 Clearman ..... A24F 47/004 131/194
5,240,012 A * 8/1993 Ehrman ..... A24D 1/22 131/194
5,353,814 A * 10/1994 Martin ..... A24F 13/00 131/175
2007/0283971 A1* 12/2007 Gidding ..... A24F 13/00 131/202
2010/0126517 A1* 5/2010 Groff ..... A24F 1/30 131/173
2012/0042885 A1* 2/2012 Stone ..... A24F 47/006 131/194
2015/0122277 A1* 5/2015 Frobisher ..... A24D 3/041 131/329
2015/0122278 A1 5/2015 Hardgrove et al.
2015/0157052 A1* 6/2015 Ademe ..... A24D 1/22 131/58
2015/0216231 A1* 8/2015 Roudier ..... A24F 47/006 131/330
2015/0296886 A1* 10/2015 Li ..... A24F 47/008 131/329
2015/0351456 A1* 12/2015 Johnson ..... A24F 47/008 131/329
2016/0192702 A1* 7/2016 Ugurhan ..... A24D 1/14 131/348
2018/0235275 A1* 8/2018 Levilev ..... A24D 3/17
2019/0307165 A1* 10/2019 Carney ..... B01D 46/0012
2020/0205468 A1* 7/2020 Nappi ..... A24F 47/008

FOREIGN PATENT DOCUMENTS

CN 104135881 A 11/2014
CN 204362974 U 6/2015
CN 105231486 A 1/2016
CN 205884677 U 1/2017
CN 107252136 A 10/2017
CN 107692316 A 2/2018
CN 207322676 U 5/2018
CN 108669642 A 10/2018
CN 109043661 A 12/2018
CN 110150757 A 8/2019
DE 102015106787 A1 11/2016

* cited by examiner

DISPOSABLE DOUBLE-CHANNEL CIGARETTE AND PREPARATION METHOD THEREOF

CROSS REFERENCE TO THE RELATED APPLICATIONS

This application is the national phase entry of International Application No. PCT/CN2019/088688, filed on May 28, 2019, the entire contents of which are incorporated herein by reference.

TECHNICAL FIELD

The present invention belongs to the field of cigarettes, and more particularly to a disposable double-channel cigarette and a preparation method thereof.

BACKGROUND

After long-term exploration and summary, it is found that tobacco products, as an addicted daily consumption, can achieve great commercial success and provide core consumption experience because they have the following three characteristics of puff-by-puff suction, free disposability, and smoking safety. Specifically, the puff-by-puff suction is compatible with the way people breathe; the free disposability brings convenience for daily consumption of cigarettes; and the smoking safety is the minimum requirement for tobacco products as food. Tobacco products that can not properly meet the above three characteristics will eventually be difficult to achieve commercial success.

In the tobacco products field, traditional tobacco products refer to burning type tobacco products, which make use of the chemical energy provided in the combustion of tobacco to induce physical and chemical reactions, and release various chemical substances for inhalation by smokers. Traditional tobacco products can be sucked puff by puff in the burning-sucking mode, and the residual can be disposed of after smoking, realizing the free disposability. The traditional tobacco products have been accepted by consumers due to the fact that they are highly in line with the daily consumption experience model and have gone through a history of hundreds of years.

With the advancement of science and technology, most studies show that during the combustion process of the traditional burning type tobacco products, thousands of substances are released due to the occurrence of pyrolysis above 800° C., which is the most criticized and considered to be the main cause of doing harm to human health. Although the filter rods with higher filtration efficiency and better ventilation and dilution effects have been constantly applied to cigarettes, today, with the constantly improved consciousness of food safety, the traditional tobacco products are increasingly difficult to meet the minimum requirements as food. In particular, products with the shortcoming of smoking safety are hardly accepted by consumers.

In recent years, with the continuous strengthening of people's demands for health, the requirements of smoking safety of cigarette have been raised to an unprecedented height. Coupled with the rapid momentum of technological innovation, as well as the strengthening of guidance and regulation of tobacco-related laws and regulations, the research on new tobacco products shows the trend of growing prosperity, and a variety of new products emerging endlessly, mainly including oral or nasal inhalation tobacco products, electronic cigarettes, heat-not-burn tobacco products (also known as low-temperature cigarettes or HNB cigarettes) and other varieties. These new tobacco products have three common characteristics. First, the harm to smokers is small, because the new tobacco products themselves do not participate in combustion when being smoked, they are considered to produce little harmful substances. Second, the harm to the environment is small, because the new tobacco products do not cause secondhand smoke, reducing the pollution of traditional tobacco products to the environment and the harm to others. Third, the new tobacco products have some characteristics of traditional tobacco products, such as containing nicotine, which can meet the physiological needs of smokers to a certain extent.

However, there are still a considerable proportion of consumers who prefer to select burning type traditional tobacco products rather than try any new tobacco products, especially those with a long smoking history who require a relatively strong smoking feeling and a high nicotine amount, or who are used to disposable cigarettes and puff-by-puff suction mode. The specific reasons include as follows: heat-not-burn tobacco product is not a one-time consumption, which is troublesome to carry, charge and use repeatedly; carbon heat-not-burn tobacco products and physical-and-chemical-reaction-based burning type tobacco products are accompanied by bad smell, smoking quality decline in the smoking process.

Then, according to the different categories of heat-not-burn tobacco products, the systematic analysis is carried out as follows.

According to the different heating sources, heat-not-burn tobacco products can be subdivided into "electric-heating tobacco product", "fuel-heating tobacco product", "physical-and-chemical-reaction-heating tobacco product". The electric-heating tobacco product is composed of a special cigarette and a electric heater, which is the mature mainstream product in the heat-not-burn tobacco products. Specifically, the most important representatives are Philip Morris International's "IQOS", British American Tobacco's "Glo" and Japanese Tobacco's "Ploom". The fuel-heating tobacco product adopts combustible solid, combustible liquid or combustible gas as heat sources, and solid (carbon) fuel-heating tobacco product has been commercialized, such as Renault Tobacco's "Premier", "Eclipse", and newly launched "Revo" in 2015. However, combustible liquid fuel-heating tobacco product and combustible gas fuel-heating tobacco product are only patented and not available in the market. The physical-and-chemical-reaction-heating tobacco product mainly heats the tobacco core material through physical and chemical methods, such as the crystal reaction belonging to the physical reaction to generate heat, or the oxidation reaction of metal iron, aluminum and copper belonging to the chemical reaction to generate heat. At present, the physical-and-chemical-reaction-heating tobacco product is only patented and not available in the market. The above-mentioned heat-not-burn tobacco products have the following technical shortcomings due to the influence of process, design and structure.

I. The electric-heating tobacco product in the prior art is composed of a special cigarette and a electric heater.

Although the electric-heating tobacco product has achieved better results in solving the two problems of puff-by-puff suction and smoking safety, such as the disclosure of the Chinese patent "heating aerosol generating device and method for producing aerosols with the same characteristics" having the patent application number CN2017108122320, the electric-heating tobacco product introduces other serious problems. Firstly, the electric-heating tobacco product is very inconvenient to carry because the special cigarette and the electric heater have to be carried at the same time; secondly, because the battery in the electric heater needs to be charged repeatedly, the electric-heating tobacco product is inconvenient to use and unable to realize free disposability; thirdly and the most importantly, the battery itself has a big safety hidden danger, the explosion of the battery integrated in the electric-heating tobacco product resulting in serious personal injury to the user has appeared and been seen in the news; and fourthly, additional disposal cost will be induced because the scrapped battery needs special treatment, and serious environmental pollution will be caused and the pressure of environmental protection will be increased if the battery is not properly disposed. To sum up, all new tobacco products that need to be used in conjunction with the battery have serious technical shortcomings and should be abandoned or eliminated.

II. The fuel-heating tobacco product in the prior art is different from the electric-heating tobacco product. Although the fuel-heating tobacco product has good basic conditions for disposable consumption, there are major technical shortcomings in the smoking safety and the puff-by-puff suction. First of all, when the fuel forms a tandem positional relationship with the tobacco, an interconnected airflow channel is formed, so that the bad substances produced in the combustion of the fuel will directly enter the mouth of the smoker because of the suction action of the smoker. Such examples include Renault Tobacco's product "Revo", the disclosure of the Chinese patent "disposable heat-not-burn cigarette" having the patent application number CN2017212244171, the disclosure of the Chinese patent "method for preparing carbon-heating low temperature-heating cigarette" having the patent application number CN2015107601314, the disclosure of the Chinese patent "dry distillation cigarette" having the patent application number CN2013101448434, and others.

When the fuel does not form a tandem positional relationship with the tobacco, for examples, the disclosure of the Chinese patent "smoking device for carbon heat-not-burn tobacco" having the patent application number CN201520038334.8, the disclosure of the Chinese patent "isolated self-overflowing carbon-toasted low-temperature cigarette and preparation method thereof" having the patent application number CN201810414111.5, the disclosure of the Chinese patent "heating low-temperature cigarette and preparation method thereof" having the patent application number CN2013105629941, and others. Such examples have the following technical shortcomings: firstly, the fuel is burned in smoldering mode with low calorific value and poor effect, resulting in the problems of incomplete-burned products, easy flameout, low heating efficiency and others; secondly, the fuel continues to burn after ignition, which is unable to fit the practice situation of constantly changing peak heat demand during puff-by-puff suction, resulting in the problems of poor heating effect of tobacco, undesirable taste and quality of smoking, and obvious fuel waste. To solve these technical shortcomings, the Chinese patent "heat-not-burn tobacco suction device based on mechanical energy storage exhaust assembly" having the patent application number CN201810982289X discloses a solution for promoting air flow by a wind-up fan, aiming to make the fuel burn as completely as possible to provide heat to the outside. The invention, however, still has significant technical shortcomings as follows: firstly, because of the high costs of the wind-up fan, the heat transfer component and others, the invention is used repeatedly rather than disposable consumption; secondly, the tobacco holding cavity used for placing tobacco substances has only one end communicated with external air, so that such structure cannot allow the consumer to smoothly perform a suction action and inhale the smoke by means of smoke flow; finally and most importantly, in the invention, the action to provide air flow for fuel presents an uncontrollable continuous characteristic, causing the great waste of fuel. Because the invention is unable to provide air flow in real time in accordance with the rhythm and mode of puff-by-puff suction, the peak value of heat provided by fuel combustion cannot be responded in real time, that is, generally speaking, in the technical solution of the invention, the cigarette, once ignited, will continuously burn regardless of the pace of the consumer just like a vehicle without brake until the fuel of the cigarette is exhausted and used up. The foregoing issues lower and even worsen consumer's experience, and therefore the technical solution should be substituted by better one.

III. The physical-and-chemical-reaction-heating tobacco product in the prior art mainly heats the tobacco core material through the physical and chemical methods, such as the crystal reaction belonging to the physical reaction to generate heat, or the oxidation reaction of metal iron, aluminum and copper belonging to the chemical reaction to generate heat. Because of the design principle, the physical-and-chemical-reaction-heating tobacco product in the prior art has significant technical shortcomings: firstly, the physical reaction or the chemical reaction may occur or even cause an explosion due to high temperatures or to collision or dropping during transportation; secondly, the chemical reaction occurring in the physical-and-chemical-reaction-heating tobacco product also has the safety problem that the waste gas may directly enter into the mouth of the smoker because of the suction action of the smoker; thirdly, similarly, once started, the physical and chemical reactions will continue to occur until the end of the reaction, which cannot provide peak heat change response to match the rhythm and mode of puff-by-puff suction.

IV. The demand for consumption of traditional burning tobacco products still exists. One of the reasons why a large number of consumers do not choose new tobacco products is the way in which new tobacco products are used. No matter which type including heat-not-burn, e-liquid atomization or chewing tobacco is used, the active ingredients of the new tobacco product, in terms of both quantity and type, are very difficult to generate more than 4,000 mixtures from traditional burning tobacco products through the pyrolysis above 800° C. by Maillard reaction. As a result, it is difficult for new tobacco products to completely replace traditional tobacco products in terms of physiological satisfaction, smoking experience and quality. In addition, a consumer's selection may change between traditional tobacco products and heat-not-burn tobacco product with time and places. For example, in a crowded environment or a dry climate, the consumer may tend to select the heat-not-burn tobacco products; in a private place or in a humid climate, the consumer may tend to choose the traditional tobacco products. To meet this requirement, the consumer now can only purchase both the traditional tobacco products and the new tobacco products concurrently, which greatly increases the consumption cost of the consumer.

V. At present, many countries or regions that permit the sale of traditional tobacco products restrict the sale of heat-not-burn cigarettes due to policies and other reasons. If a cigarette can be switched between the traditional burning mode and the heat-not-burn mode, then the policy restrictions on the product may be greatly reduced, thereby theoretically diminishing the difficulty of entering the above-mentioned countries or regions.

SUMMARY

In order to solve the above problems, the present invention is proposed.

The present invention provides a disposable double-channel cigarette, including:

a tobacco unit including a tobacco unit channel, a suction end and an ignition end;

a heat source unit including a heat source unit channel;

wherein, an axis of the tobacco unit channel and an axis of the heat source unit channel are arranged in parallel or in a line, and an air-tight heat conduction layer6 is arranged at the contact portion between the tobacco unit channel and the heat source unit channel; a pneumatic device and a tobacco component are arranged in the tobacco unit channel; an air extraction device and a fuel component are arranged in the heat source unit channel; a linkage device is arranged between the pneumatic device and the air extraction device, and the linkage device can transfer power between the pneumatic device and the air extraction device.

Preferably, the tobacco unit is at least partially inserted into the heat source unit, or the heat source unit is at least partially inserted into the tobacco unit, or the tobacco unit and the heat source unit are juxtaposed and at least partially in contact with each other.

Preferably, the quantity of the tobacco unit is at least one, and the quantity of the heat source unit is at least one.

Preferably, the disposable double-channel cigarette further includes a filter unit including a filter unit channel, wherein the filter unit including the filter unit channel is arranged at the suction end of the tobacco unit.

Preferably, the ignition end of the tobacco unit is provided with a detachable permeable flame retardant element. When the flame retardant element is arranged, the cigarette is suitable for the heat-not-burn mode, and the flame retardant element plays a flame retardant role while ensuring the smooth passing of airflow, thereby avoiding the tobacco component from being ignited simultaneously when the fuel component is ignited; when the flame retardant element is not arranged, the cigarette is suitable for the traditional burning mode, i.e., the tobacco component is ignited simultaneously when the fuel component is ignited, thus becoming a traditional cigarette.

Preferably, the pneumatic device is a fan or a turbine, and the air extraction device is a fan or a turbine.

Preferably, the pneumatic device and the air extraction device are arranged independently of each other, and no airflow exchange exists between the pneumatic device and the air extraction device.

Specifically, the pneumatic device is configured to be driven by the airflow, and the air extraction device is configured to drive the airflow.

Preferably, the linkage device is a magnetic linkage device or a mechanical linkage device.

Preferably, the pneumatic device and the air extraction device are arranged at the suction end of the tobacco unit.

Preferably, the heat source unit channel is provided with a burnt waste gas outlet4 downstream of the air extraction device.

Specifically, the air-tight heat conduction layer6 may be incombustible. The purpose is that in the heat-not-burn mode, the fuel component of the heat source unit burns to generate heat and then provides the heat to the tobacco unit only in a thermal conduction mode to heat the tobacco component, and the heat transfer is not carried out in a gas convection mode or in a thermal radiation mode. In the traditional burning mode, even if the tobacco component starts to burn, the tobacco unit channel and the heat source unit channel are still separated by the heat-conducting and incombustible material, so as to prevent the burnt waste gas from being sucked into human body.

Specifically, the quantity of the tobacco unit channel is at least one, the quantity of the heat source unit channel is at least one, and the quantity of the filter unit channel is at least one, and a cross section of the channel is circular, semicircular, square or concentric circle.

Two parts of the linkage device respectively located in the tobacco unit channel and the heat source unit channel are named as a first linkage device and a second linkage device, respectively.

Preferably, the flame retardant element is a granular substance or a porous substance that does not participate in combustion and allows the airflow to smoothly pass through. Further, the flame retardant element is an extruded clay particle.

Preferably, the outer wall of the cigarette is provided with a wrapping material layer, wherein the wrapping material layer is a paper, an aluminum foil, or a thin iron sheet. The wrapping material layer burns or does not burn in the two smoking modes. Specifically, the wrapping material layer can directly form the tobacco unit channel and the heat source unit channel.

Preferably, the fuel component is made of a material that provides the heat by burning and has a good airflow permeability. Further, the fuel component is added with different proportions of flame retardant substances to adjust its own burning rate. Specifically, The fuel component is a carbon rod with a certain structure, carbon particles with certain structures, and/or a solid alcohol filled with clay particles, or a hollow solid alcohol.

Preferably, the tobacco component is a cut tobacco, a tobacco sheet, or a tobacco stem prepared from at least one of ethylene glycol, glycerin, sugar, licorice, cocoa, honey, and jujube tincture. Further, the tobacco component is a prepared tobacco sheet.

Preferably, the filter unit is filled with a fragrance generating component or a water generating component.

The technical features of the cigarette of the present invention are as follows.

In the tobacco unit channel, the air is driven by the negative pressure provided by the mouth of the smoker during suction to flow, and the flowing air provides sufficient power to initiate the pneumatic device in the tobacco unit channel. The power is transferred through the linkage device to the air extraction device in the heat source unit channel, and then the air extraction device operates to cause the air to flow in the heat source unit channel to permit more oxygen to enter the heat source unit channel, thereby accelerating the burning of the fuel component in the heat source unit channel.

Under the two smoking modes, the above design has the following advantages.

1. The accelerated burning of the fuel component arranged internally can provide sufficient heat for the tobacco component in the tobacco unit to quickly raise the tobacco component to the desired temperature.

2. The intensity of the airflow in the heat source unit channel is synchronized with the rhythm of the suction action of the smoker, so that it is similar to the traditional burning cigarette and can match the peak value change of heat required by puff-by-puff suction.

3. By designing a tobacco unit and a heat source unit which are arranged independently of each other and have no airflow exchange, the burnt airflow is completely separated from the sucked airflow, thereby totally preventing the bad substances produced due to the complete or incomplete combustion of the fuel material in the heat source unit, such as burnt waste gases, harmful gases, aerosols, particles and other substances, from being ingested into the body via the mouth of the smoker along with the suction action of the smoker.

The second aspect of the present invention provides a method for preparing the cigarette described in the first aspect of the present invention, which includes the following steps:

A, preparing the tobacco unit including the tobacco unit channel, the pneumatic device and the tobacco component;

B, preparing the heat source unit including the heat source unit channel, the air extraction device and the fuel component;

C, assembling the tobacco unit prepared in step A with the heat source unit prepared in step B; wherein the pneumatic device and the air extraction device are connected by the linkage device in a power transfer manner; the axis of the tobacco unit channel and the axis of the heat source unit channel are arranged in parallel or in the line, and the air-tight heat conduction layer6 is arranged at the contact portion between the tobacco unit channel and the heat source unit channel, thereby obtaining the cigarette. Specifically, the linkage device is prepared during, before or after the preparations of the tobacco unit and the heat source unit.

Preferably, the method further includes the following step:

D, preparing the filter unit including the filter unit channel, and the prepared filter unit is arranged at the suction end of the tobacco unit, wherein step C and step D do not have to be performed in the presented order.

Preferably, in step C, the air-tight heat conduction layer6 may also be formed in step A during the preparation of the tobacco unit or step B during the preparation of the heat source unit.

Specifically, two parts of the linkage device respectively located in the tobacco unit channel and the heat source unit channel are named as the first linkage device and the second linkage device, respectively.

The present invention has the following advantages:

1. Compared with the fuel-heating tobacco products in the prior art, the disposable double-channel cigarette of the present invention can match the puff-by-puff suction mode and provide the heat by using the pneumatic device and the linkage device. In addition, tobacco and heat source respectively have airflow channels that are independent of each other, have no air exchange and are arranged in parallel, thereby completely avoiding the harmful substances produced during fuel combustion from being ingested into the body of the smoker.

2. Compared with the physical-and-chemical-reaction-heating tobacco products in the prior art, the disposable double-channel cigarette of the present invention eliminates the possibility that the physical and chemical heating reaction occur unexpectedly and even induce explosion, avoids the shortcoming that the physical and chemical reaction processes cannot be intervened and controlled, and completely avoids the waste gas produced by the physical and chemical reactions during heating from being ingested into the body of the smoker.

3. Compared with the new tobacco products in the prior art, the disposable double-channel cigarette of the present invention can meet the different needs of different consumers for cigarette consumption because it takes into account the needs of both the traditional burning mode and the heat-not-burn mode. For example, some people like traditional cigarettes and some others like new tobacco products. In addition, the different cigarette consumption demands of a consumer in different stages or different environments or different occasions are satisfied, for example, in the humid climate or place, the consumer may like the traditional burning mode; while in the dry climate or place, the consumer may like the heat-not-burn mode. For another example, in private space, it is suitable for smoking the traditional burning cigarette; in a crowded smoking areas, it is suitable for selecting the heat-not-burn cigarette, and so on. The disposable dual-channel cigarette of the present invention provides a convenient solution, which expands the field of application, greatly improves the product coverage and competitiveness, and reduces costs.

4. The disposable double-channel cigarette of the present invention does not require the electric heater and its matching battery, and is convenient to carry and simple to use. Moreover, the disposable double-channel cigarette does not have the trouble of repeatedly charging the matching battery of the electric heater, avoids the safety hidden danger caused by the explosion of the battery, and reduces the environmental pollution caused by the scrapped battery.

5. Compared with the new tobacco products in the prior art, the disposable double-channel cigarette of the present invention is neither a complete traditional tobacco product nor a complete new heat-not-burn tobacco product, instead, the disposable double-channel cigarette can be switched between the traditional burning mode and the heat-not-burn mode. As a result, the disposable double-channel cigarette is less restricted by the policy, thereby facilitating access to the wide international and domestic markets and improving the market competitiveness of the product.

Figure 1:
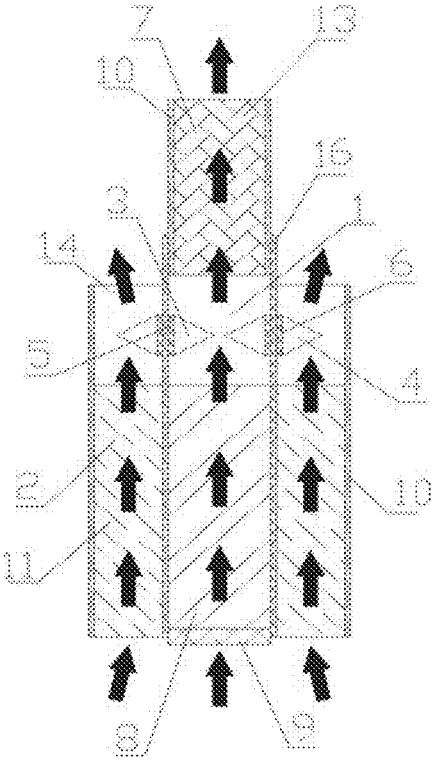
FIG. 1 is a schematic diagram showing the working principle of the cigarette of the present invention in the heat-not-burn mode.
Figure 2:
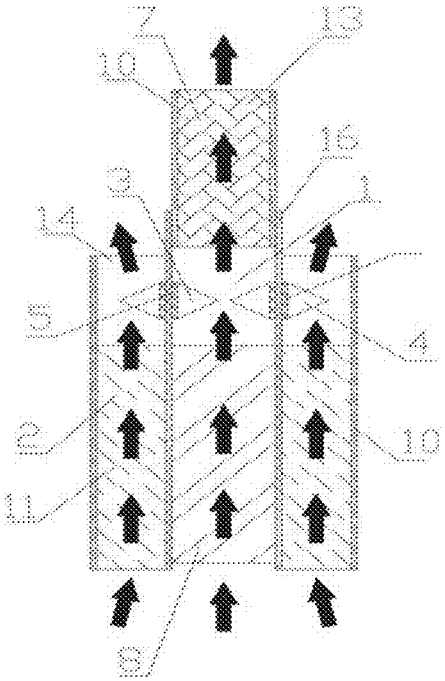
FIG. 2 is a schematic diagram showing the working principle of the cigarette of the present invention in the traditional burning mode.
Figure 3:
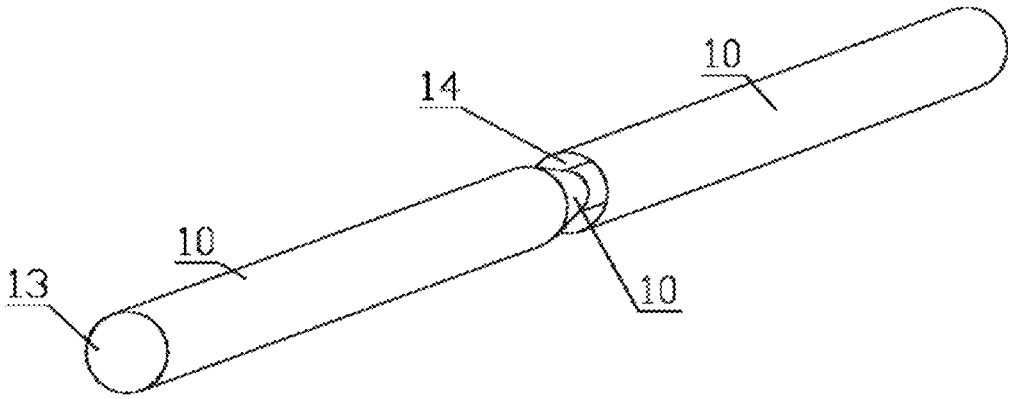
FIG. 3 is a three-dimensional diagram showing the overall look of the cigarette according to embodiment 1 of the present invention.
Figure 4:
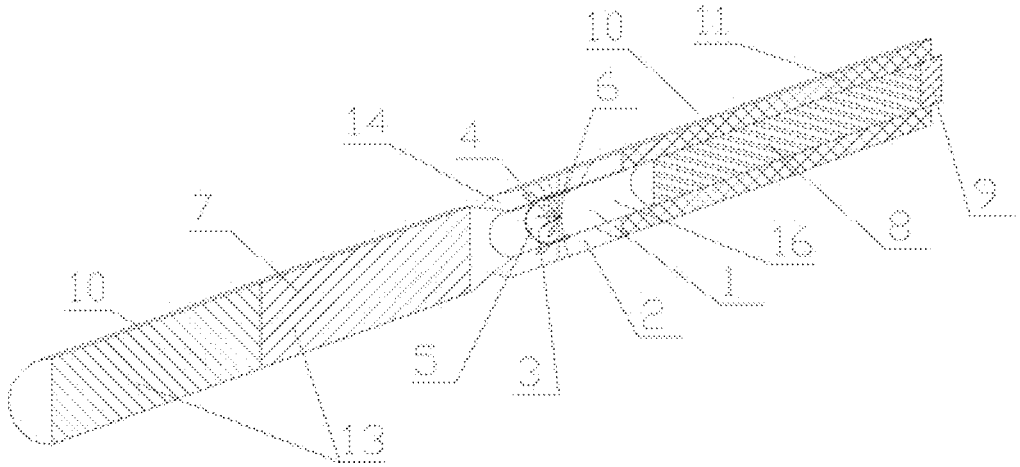
FIG. 4 is a three-dimensional cross-sectional view of the cigarette in the heat-not-burn mode according to embodiment 1 of the present invention.
Figure 5:
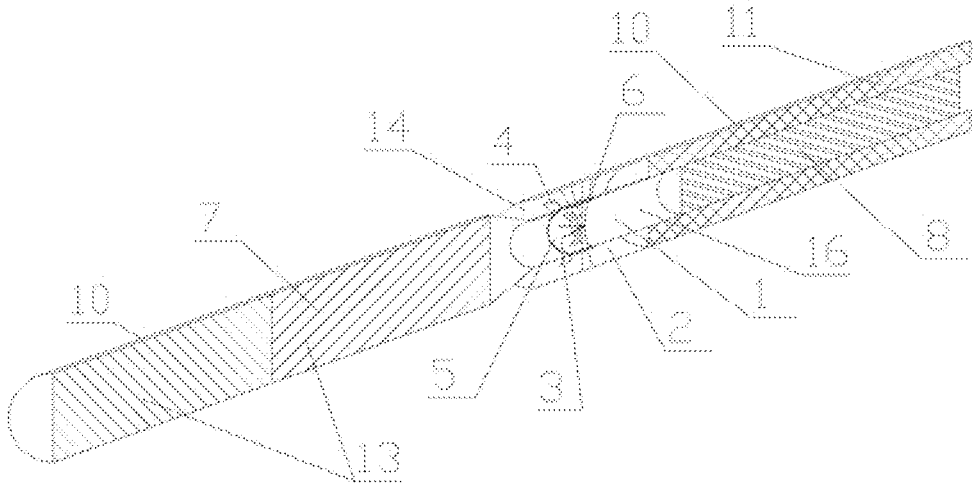
FIG. 5 is a three-dimensional cross-sectional view of the cigarette in the traditional burning mode according to embodiment 1 of the present invention.
Figure 6:
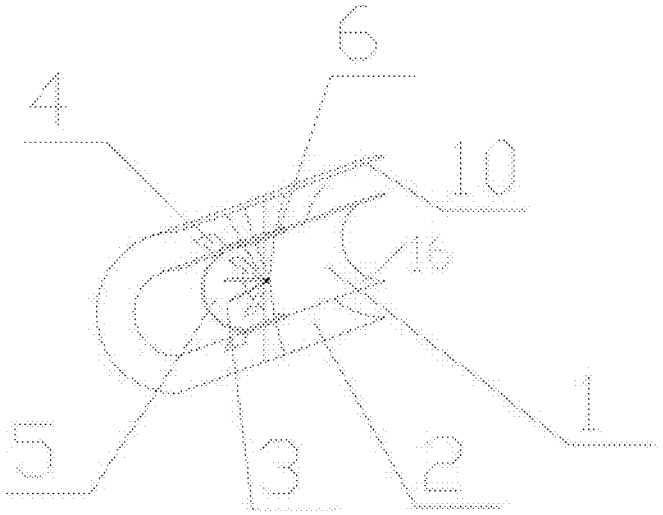
FIG. 6 is a three-dimensional cross-sectional view showing the assembly of the pneumatic device and the linkage device of the cigarette according to embodiment 1 of the present invention.
Figure 7:
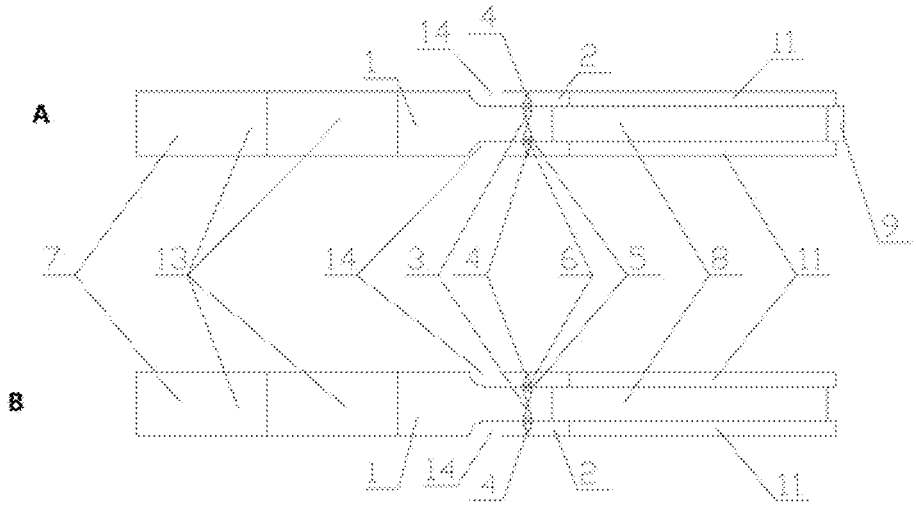
FIG. 7 is a cross-sectional view of the cigarette according to embodiment 1 of the present invention, wherein A represents the heat-not-burn mode, and B represents the traditional burning mode.
Figure 8:
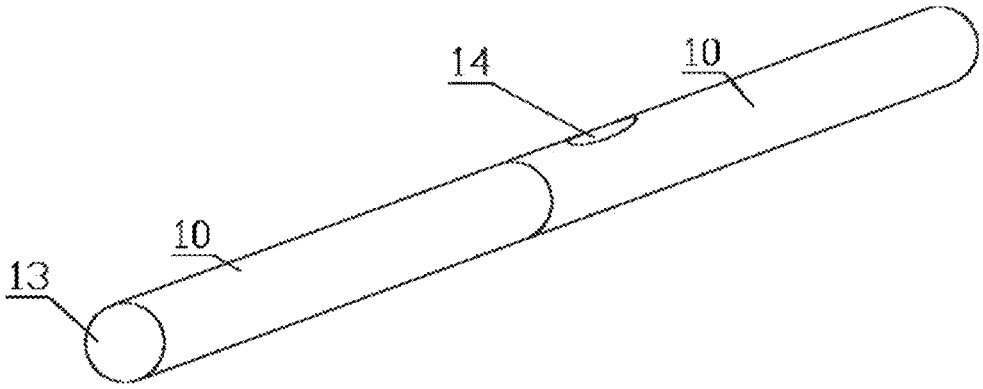
FIG. 8 is a three-dimensional diagram showing the overall look of the cigarette according to embodiment 2 of the present invention.
Figure 9:
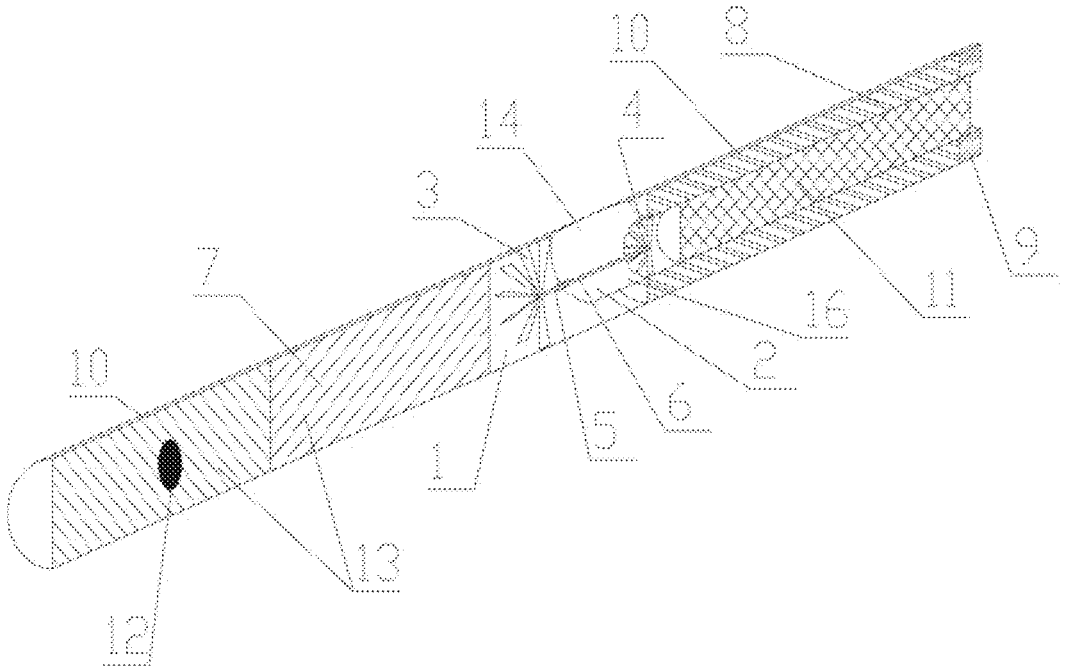
FIG. 9 is a three-dimensional cross-sectional view of the cigarette in the heat-not-burn mode according to embodiment 2 of the present invention.
Figure 10:
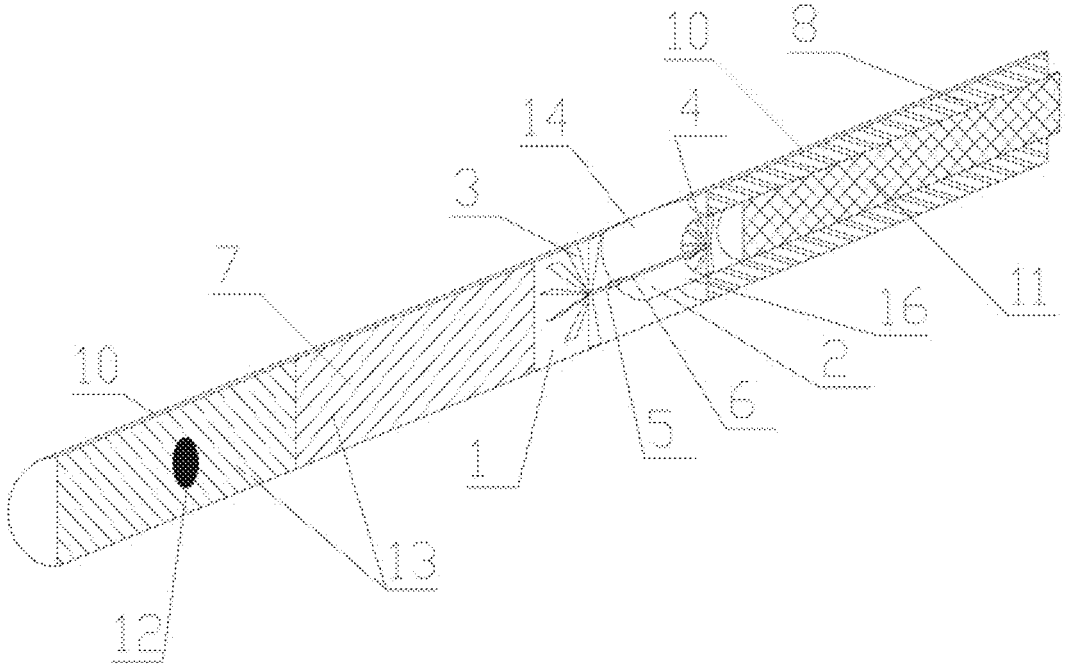
FIG. 10 is a three-dimensional cross-sectional view of the cigarette in the traditional burning mode according to embodiment 2 of the present invention.
Figure 11:
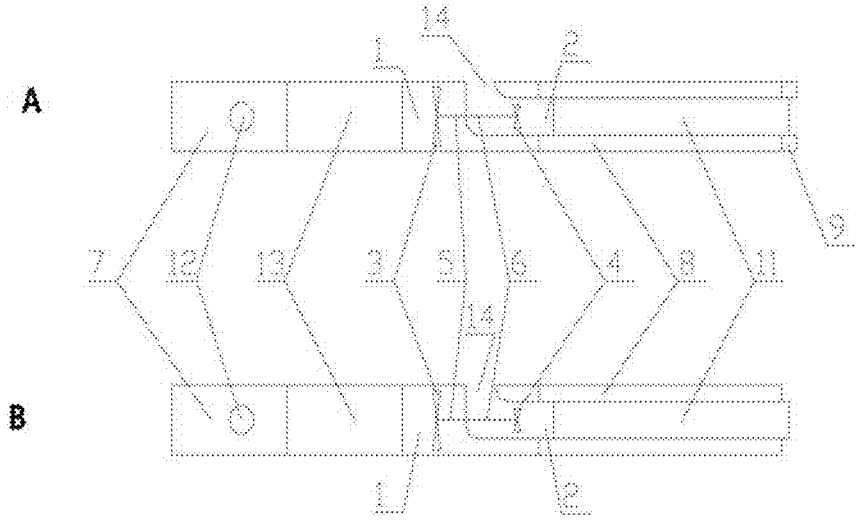
FIG. 11 is a cross-sectional view of the cigarette according to embodiment 2 of the present invention, wherein A represents the heat-not-burn mode, and B represents the traditional burning mode.
Figure 12:
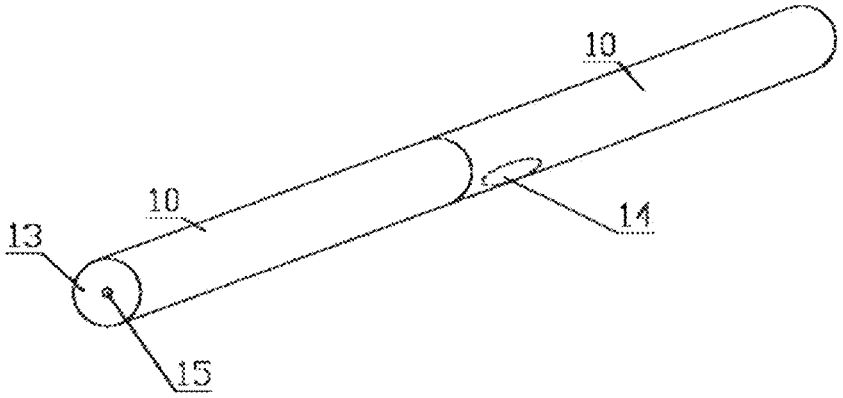
FIG. 12 is a three-dimensional diagram showing the overall look of the cigarette according to embodiment 3 of the present invention.
Figure 13:
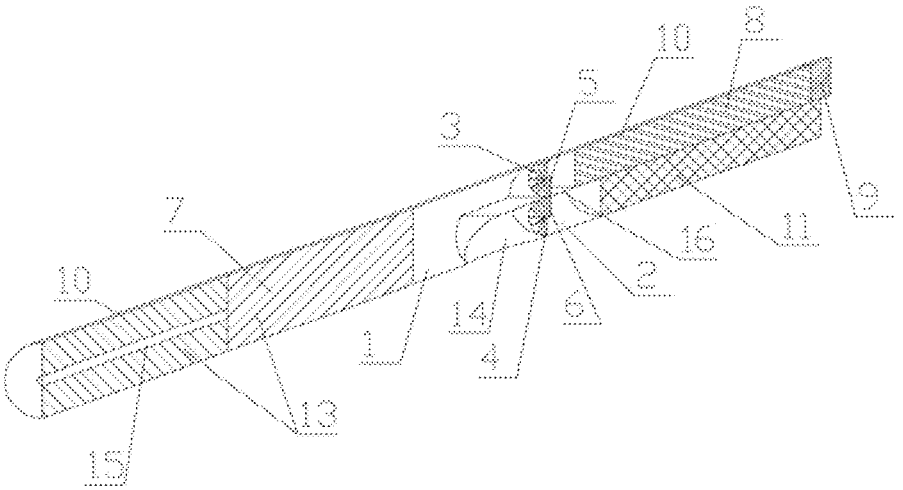
FIG. 13 is a three-dimensional cross-sectional view of the cigarette in the heat-not-burn mode according to embodiment 3 of the present invention.
Figure 14:
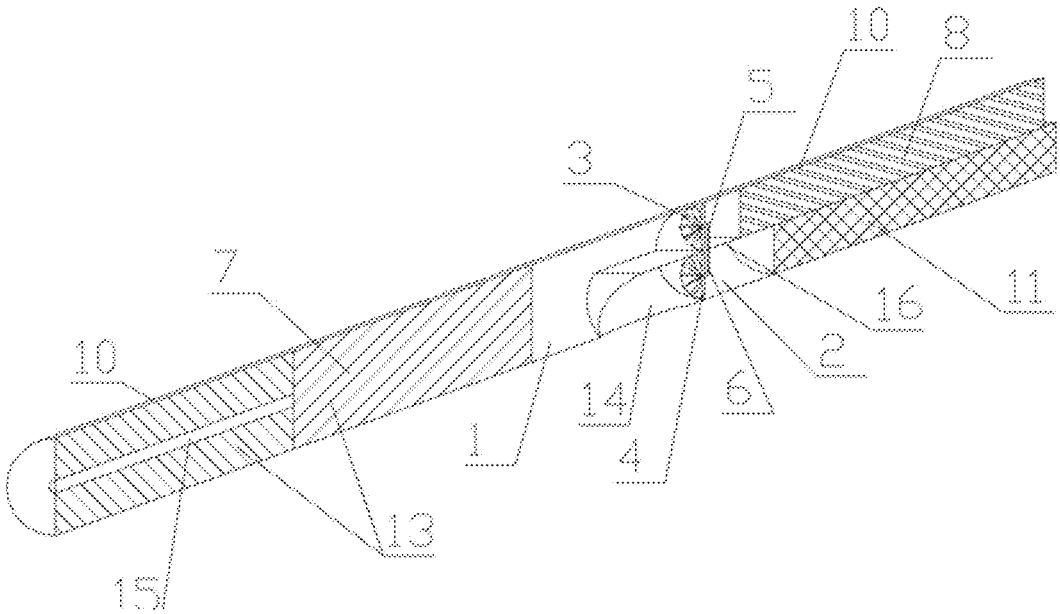
FIG. 14 is three-dimensional cross-sectional view of the cigarette in the traditional burning mode according to embodiment 3 of the present invention.
Figure 15:
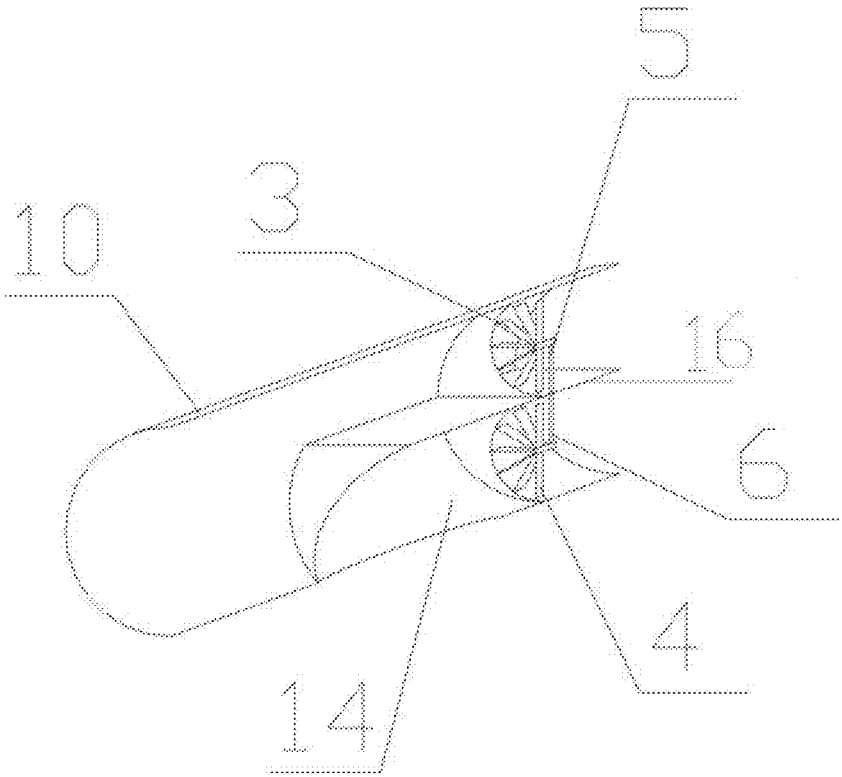
FIG. 15 is a three-dimensional cross-sectional view showing the assembly of the pneumatic device and the linkage device of the cigarette according to embodiment 3 of the present invention.
Figure 16:
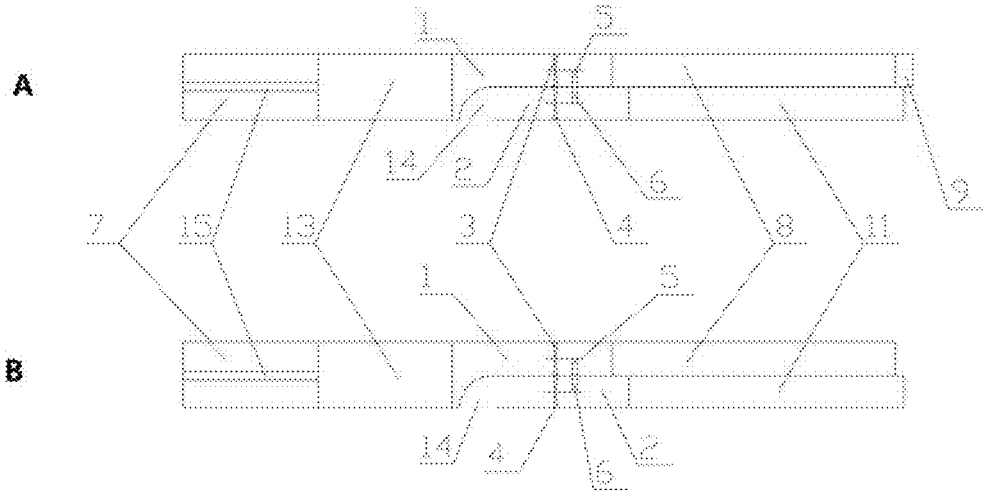
FIG. 16 is a cross-sectional view of the cigarette according to embodiment 3 of the present invention, wherein A represents the heat-not-burn mode, and B represents the traditional burning mode.

1, tobacco unit channel; 2, heat source unit channel; 3, pneumatic device; 4, air extraction device; 5, first linkage device; 6, second linkage device; 7, filter unit channel; 8, tobacco component; 9, flame retardant element; 10, wrapping material layer; 11, fuel component; 12, capsule; 13, filter material; 14, burnt waste gas outlet; 15, spice line; 16, air-tight heat conduction layer.

DETAILED DESCRIPTION OF THE EMBODIMENTS

The present invention is further described below through specific embodiments.

Embodiment 1

1. Preparation of Tobacco Unit

The aluminum foil, as the air-tight heat conduction layer 16, is made into a tubular element to be used as a tobacco unit member. One end of the tobacco unit member is the ignition end, and the other end of the tobacco unit member is the suction end. The cut tobaccos prepared by ethylene glycol, glycerin, cocoa, honey and jujube tincture are used as the tobacco component 8 to be filled in the middle portion of the tobacco unit member. The granular and well-ventilated clay particles are used as the flame retardant element 9 to be filled to the ignition end of the tobacco unit member. A fan as the pneumatic device 3 is arranged on the tobacco unit member close to the suction end, and the magnet as the first linkage device 5 is arranged on the pneumatic device 3. Thus, the tobacco unit is completely prepared and ready for use.

2. Preparation of Heat Source Unit

The paper, as the wrapping material layer 10, is made into a tubular element with a larger inner diameter than the above tobacco unit member to be used as a heat source unit member. The activated carbon particles and clay particles are proportionally mixed and used as the fuel component 11. The fuel component 11 is filled in the inner wall of the heat source unit member and is arranged close to the ignition end of the tobacco unit member. A fan as the air extraction device 4 is arranged on the heat source unit member close to the suction end of the tobacco unit member, and the magnet as the second linkage device 6 is arranged on the air extraction device 4. Thus, the heat source unit is completely prepared and ready for use.

3. Preparation of Filter Unit

The loosened cellulose acetate with the plasticizer is used as the filter material 13 and is made into a cylinder. The wrinkled polyethylene (PE) sheet material as the filter material 13 is made into another cylinder. A plurality of filter unit channels 7 are arranged in each cylinder, the two cylinders are connected in series, and the paper as the wrapping material layer 10 wraps the two cylinders. Thus, the filter unit is completely prepared and ready for use.

4. Assembly

The tobacco unit is inserted into the heat source unit along the central axis of the heat source unit, and the burnt waste gas outlet 14 on the heat source unit is formed between the tobacco unit and the heat source unit. At this time, the tobacco unit is parallel to the heat source unit, and the interaction force caused by the magnetic force between the pneumatic device 3 and the air extraction device 4 reaches the maximum. Then, the filter unit is arranged on the tobacco unit close to the suction end of the tobacco unit member to obtain a complete cigarette. The complete cigarette is suitable for the heat-not-burn mode, while the cigarette without the flame retardant element 9 is suitable for the burning mode.

Embodiment 2

1. Preparation of Tobacco Unit

The tobacco unit of the present embodiment is different from that of embodiment 1 in that the paper as the wrapping material layer 10 is made into a tubular element with a relatively large inner diameter, and the linkage device is not prepared for the time being.

2. Preparation of Heat Source Unit

The heat source unit of the present embodiment is different from that of embodiment 1 in that the aluminum foil as the air-tight heat conduction layer 16 is made into a tubular element with a relatively small inner diameter, and a continuous carbon rod with desired structure is extruded as the fuel component 11.

3. Preparation of Filter Unit

The loosened polypropylene fiber with the plasticizer is used as the filter material 13 and is made into two cylinders, and the two cylinders are provided with a plurality of filter unit channels 7, wherein the middle portion of one of the two cylinders is inlaid with the capsule 12. The content in the capsule 12 may be water, fat-soluble spice, or alcoholsoluble spice, so that when the capsule 12 is cracked, the content is released into the filter unit, thereby enriching the smell of the smoke, increasing the moisture content of the smoke and reducing the temperature of the smoke. The paper as the wrapping material layer 10 wraps the two cylinders. Thus, the filter unit channels 7 are completely prepared and ready for use.

4. Assembly

A long rod is selected as the linkage device to coaxially connect the pneumatic device 3 and the air extraction device 4. The two parts of the long rod respectively located in the tobacco unit channel 1 and the heat source unit channel 2 are named as the first linkage device 5 and the second linkage device 6, respectively. The filter unit is connected and arranged on the tobacco unit close to the suction end, and then the prepared heat source unit is inserted into the tobacco unit along the central axis of the tobacco unit, wherein the burnt waste gas outlet 14 is reserved on the heat source unit. At this time, the tobacco unit is parallel to the heat source unit, and the pneumatic device 3 and the air extraction device 4 are connected through the long rod to obtain a complete cigarette. The complete cigarette is suitable for the heat-not-burn mode, while the cigarette without the flame retardant element 9 is suitable for the burning mode.

Embodiment 3

1. Preparation of Tobacco Unit

The tobacco unit of the present embodiment is different from that of embodiment 1 in that the aluminum foil as the wrapping material layer 10 is made into a tubular element with a semicircular cross section.

2. Preparation of Heat Source Unit

The heat source unit of the present embodiment is different from that of embodiment 1 in that the aluminum foil as the air-tight heat conduction layer 16 is made into a tubular element with a semicircular cross section, and a strip-shaped solid alcohol with a hollow cross section is selected as the fuel component 11.

3. Preparation of Filter Unit

The loosened polypropylene fiber with the plasticizer is used as the filter material 13 and is made into two cylinders, and the two cylinders are provided with a plurality of filter unit channels 7, wherein the central axis of one of the two cylinders is inlaid with the spice line 15. The spice line 15 is provided with the citrus extract to enrich the smell of the smoke and reduce the temperature of the smoke. The paper as the wrapping material layer 10 wraps the two cylinders. Thus, the filter unit is completely prepared and ready for use.

4. Assembly

A belt is selected as the linkage device to connect the pneumatic device 3 and the air extraction device 4. The two parts of the belt respectively located in the tobacco unit channel 1 and the heat source unit channel 2 are named as the first linkage device 5 and the second linkage device 6, respectively. The heat source unit with the semicircular cross section and the tobacco unit with the semicircular cross section are assembled side by side along the axis of the cylinders of the filter unit to form a cylinder, wherein the burnt waste gas outlet 14 is reserved on the heat source unit. At this time, the tobacco unit is parallel to the heat source unit, and then the filter unit is arranged on the tobacco unit close to the suction end to obtain a complete cigarette. The complete cigarette is suitable for the heat-not-burn mode, while the cigarette without the flame retardant element 9 is suitable for the burning mode.

Embodiment 4

Application: Flexible Consumption Pattern Comparison Experiment (1) The disposable double-channel cigarettes prepared in embodiments 1, 2 and 3 are adopted as the experimental groups.

(2) The traditional cigarette consumed in the burning mode is adopted as the control group 1.

(3) The electronic cigarette (i.e., IQOS of Philip Morris International) consumed in the heat-not-burn mode is adopted as the control group 2.

(4) The tandem-type HNB cigarette (i.e. Revo of the R. J. Reynolds Tobacco Company) consumed in the carbon-heat-not-burn mode is adopted as the control group 3.

The samples of the above embodiments and the samples of the control groups are used in the flexible consumption pattern comparison experiment, and the results are shown in Table 1 below.

TABLE 1

Results of the flexible consumption pattern comparison experiment

| Sampling groups | Whether to meet the consumption demand under the traditional burning mode | Whether to meet the consumption demand under the heat-not-burn mode |
|---|---|---|
| Embodiment 1 | Yes | Yes |
| Embodiment 2 | Yes | Yes |
| Embodiment 3 | Yes | Yes |
| Control group 1 | Yes | No |
| Control group 2 | No | Yes |
| Control group 3 | No | Yes |

Conclusion: because the cigarettes in control group 1, control group 2 and control group 3 can only adapt to or meet the consumption demand under a single mode, the consumption cost thereof will rise greatly and the market competitiveness thereof will be weak under the background of diversified demand. These cigarettes are very likely to be replaced by products using new technologies. The cigarette of the present invention can flexibly adapt to and meet the consumption demands of different patterns, which has a broad application prospect.

Embodiment 5

Application: Smoke Index Detection Comparison Experiment (1) The disposable double-channel cigarettes prepared in embodiments 1, 2 and 3 are adopted as the experimental groups.

(2) The traditional cigarette consumed in the burning mode is adopted as the control group 1.

(3) The electronic cigarette (i.e., IQOS of Philip Morris International) consumed in the heat-not-burn mode is adopted as the control group 2.

(4) The tandem-type HNB cigarette (i.e. Revo of the R. J. Reynolds Tobacco Company) consumed in the carbon-heat-not-burn mode is adopted as the control group 3.

The samples of the above embodiments and the samples of the control groups are used in the smoke index detection comparison experiment, and the results are shown in Table 2 below.

TABLE 2

Results of the smoke index detection comparison experiment (unit: mg)

| Sampling groups | Smoke index under the traditional burning mode | | | Smoke index under the heat-not-burn mode | | |
|---|---|---|---|---|---|---|
| | Tar | Smoking nicotine | CO | Tar | Smoking nicotine | CO |
| Embodiment 1 | 8.3 | 0.81 | 7.5 | 0.79 | 0.06 | 0 |
| Embodiment 2 | 8.1 | 0.79 | 8.0 | 0.76 | 0.08 | 0 |
| Embodiment 3 | 8.6 | 0.88 | 8.5 | 0.81 | 0.07 | 0 |
| Control group 1 | 9.5 | 1.1 | 12.0 | — | — | — |
| Control group 2 | — | — | — | 0.77 | 0.07 | 0 |
| Control group 3 | — | — | — | 0.9 | 0.1 | 10.9 |

Conclusion: under the traditional burning mode, the results of the smoke index detection of the cigarettes in embodiment 1, embodiment 2 and embodiment 3 are close to those of the control group 1, and all indexes thereof are slightly less than those of the control group 1. Under the heat-not-burn mode, the results of the smoke index detection of the cigarettes in embodiment 1, embodiment 2 and embodiment 3 are overall close to those of the control group 2; and the harmful indexes of the cigarettes in embodiment 1, embodiment 2 and embodiment 3 are significantly lower than those of control group 3, especially the index of the harmful substance carbon monoxide (CO) is much lower than that of the control group 3. Therefore, the content of the nicotine in the smoke of the cigarette of the present invention is basically unchanged, but the content of harmful gases is reduced, which has a broad application prospect.

Embodiment 6

Application: Sensory Evaluation Comparison Experiment (1) The disposable double-channel cigarettes prepared in embodiments 1, 2 and 3 are adopted as the experimental groups.

(2) The traditional cigarette consumed in the burning mode is adopted as the control group 1.

(3) The electronic cigarette (i.e., IQOS of Philip Morris International) consumed in the heat-not-burn mode is adopted as the control group 2.

(4) The tandem-type HNB cigarette (i.e. Revo of the R. J. Reynolds Tobacco Company) consumed in the carbon-heat-not-burn mode is adopted as the control group 3.

The samples of the above embodiments and the samples of the control groups are used in the sensory evaluation comparison experiment, and the results are shown in Table 3 below.

TABLE 3

Results of the sensory evaluation comparison experiment

| Sampling groups | Sensory evaluation under the traditional burning mode | | Sensory evaluation under the heat-not-burn mode | |
|---|---|---|---|---|
| | Sensory evaluation score | Sensory evaluation description | Sensory evaluation score | Sensory evaluation description |
| Embodiment 1 | 92 | The aroma has good quality, is exquisite, sufficient, and harmonious, has no obvious miscellaneous gas; the stimulus is relatively little; the aftertaste is clean. | 95 | The aroma has good quality, is exquisite, sufficient, and harmonious, has no obvious miscellaneous gas; the stimulus is little; the aftertaste is clean and comfortable. |
| Embodiment 2 | 91 | The aroma has good quality, is exquisite, sufficient, and harmonious, has no obvious miscellaneous gas; the stimulus is relatively little; the aftertaste is clean. | 96 | The aroma has good quality, is exquisite, sufficient, and harmonious, has no obvious miscellaneous gas; the stimulus is little; the aftertaste is clean and comfortable. |
| Embodiment 3 | 92 | The aroma has good quality, is exquisite, sufficient, and harmonious, has no obvious miscellaneous gas; the stimulus is relatively little; the aftertaste is clean. | 95 | The aroma has good quality, is exquisite, sufficient, and harmonious, has no obvious miscellaneous gas; the stimulus is little; the aftertaste is clean and comfortable. |
| Control group 1 | 90 | The aroma is exquisite, sufficient, and harmonious, has no obvious miscellaneous gas; the stimulus is moderate; the aftertaste is clean. | — | — |
| Control group 2 | — | — | 94 | The aroma has good quality, is exquisite, sufficient, and harmonious, has no obvious miscellaneous gas; the stimulus is little; the aftertaste is clean. |

TABLE 3-continued

Results of the sensory evaluation comparison experiment

| Sampling groups | Sensory evaluation under the traditional burning mode | | Sensory evaluation under the heat-not-burn mode | |
|---|---|---|---|---|
| | Sensory evaluation score | Sensory evaluation description | Sensory evaluation score | Sensory evaluation description |
| Control group 3 | — | — | 93 | The aroma has good quality, is exquisite, sufficient, and harmonious, has no obvious miscellaneous gas; the stimulus is little; the aftertaste is clean. |

Conclusion: on the basis of flexibly meeting different consumption demands for different modes, the cigarettes in embodiment 1, embodiment 2 and embodiment 3 have less stimulus that that in the control group 1, and have more comfortable aftertaste than those in control group 2 and control group 3. Therefore, the sensory quality of the cigarette of the present invention is obviously improved and has a broad application prospect.

Embodiment 7

Application: Puff-by-Puff Suction Mode Experiment (1) The disposable double-channel cigarettes prepared in embodiments 1, 2 and 3 are adopted as the experimental groups 1-3.

(2) The traditional cigarette consumed in the burning mode is adopted as the control group 1.

(3) The electronic cigarette (i.e., IQOS of Philip Morris International) consumed in the heat-not-burn mode is adopted as the control group 2.

(4) The tandem-type HNB cigarette (i.e. Revo of the R. J. Reynolds Tobacco Company) consumed in the carbon-heat-not-burn mode is adopted as the control group 3.

(5) Using the method disclosed by the Chinese Patent No. 102018000982289 "heat-not-burn tobacco suction device based on mechanical energy storage exhaust assembly", the suction device is made and filled with the cut tobacco, which is used as the control group 4.

Figure 17:
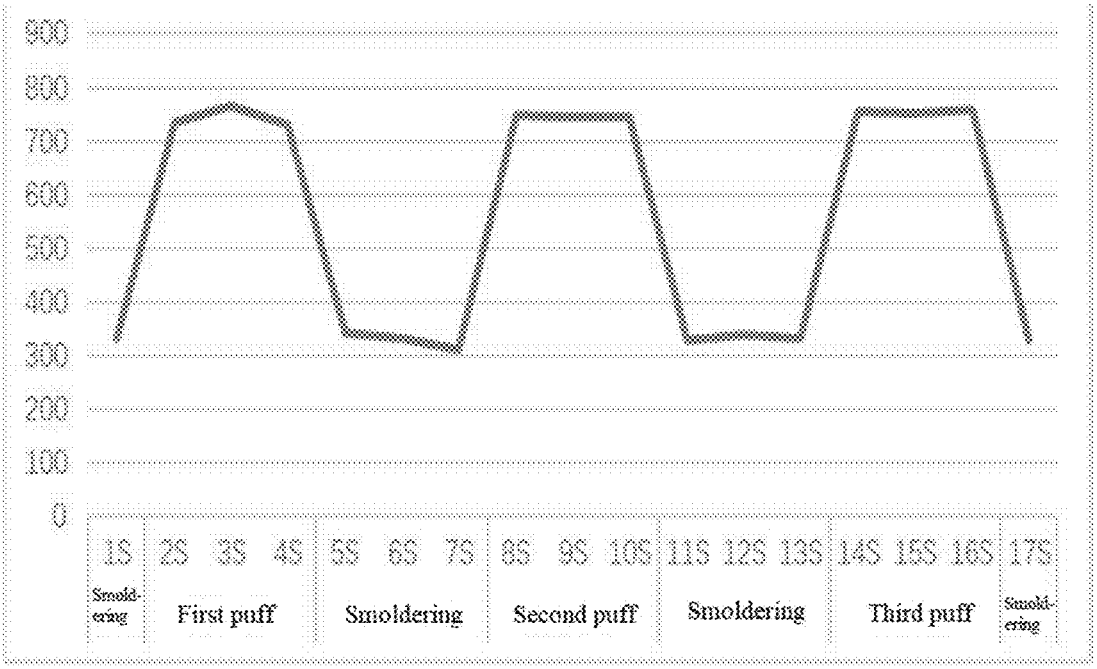
FIGS. 17-19 are the peak value change curves of the heat of the cigarettes in embodiments 1-3 of the present invention during the suction process, wherein the heat is expressed as temperature in unit of ° C.
Figure 18:
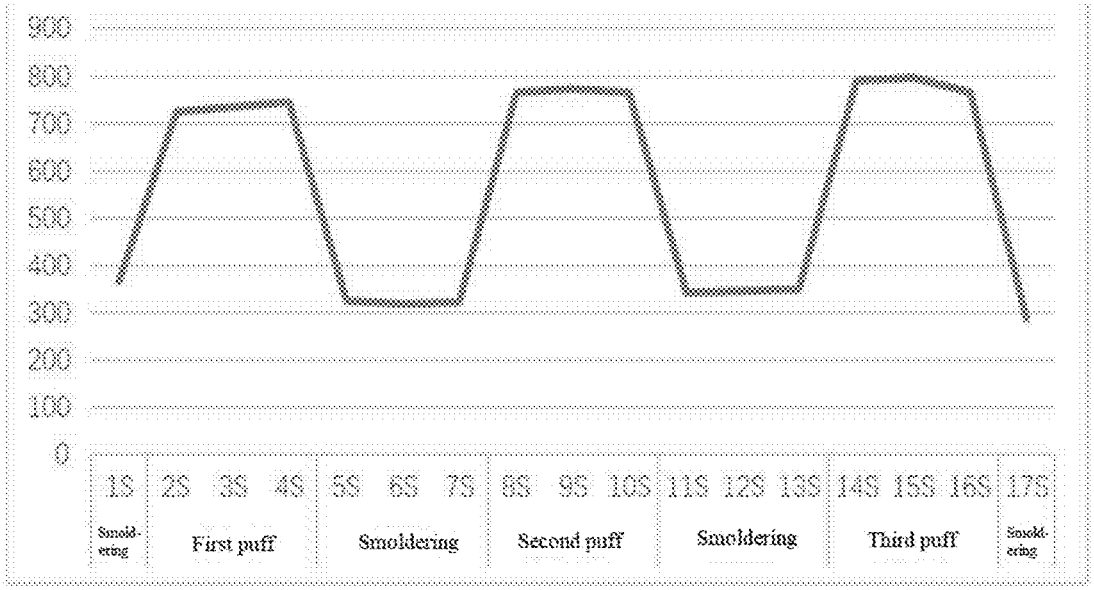
Figure 19:
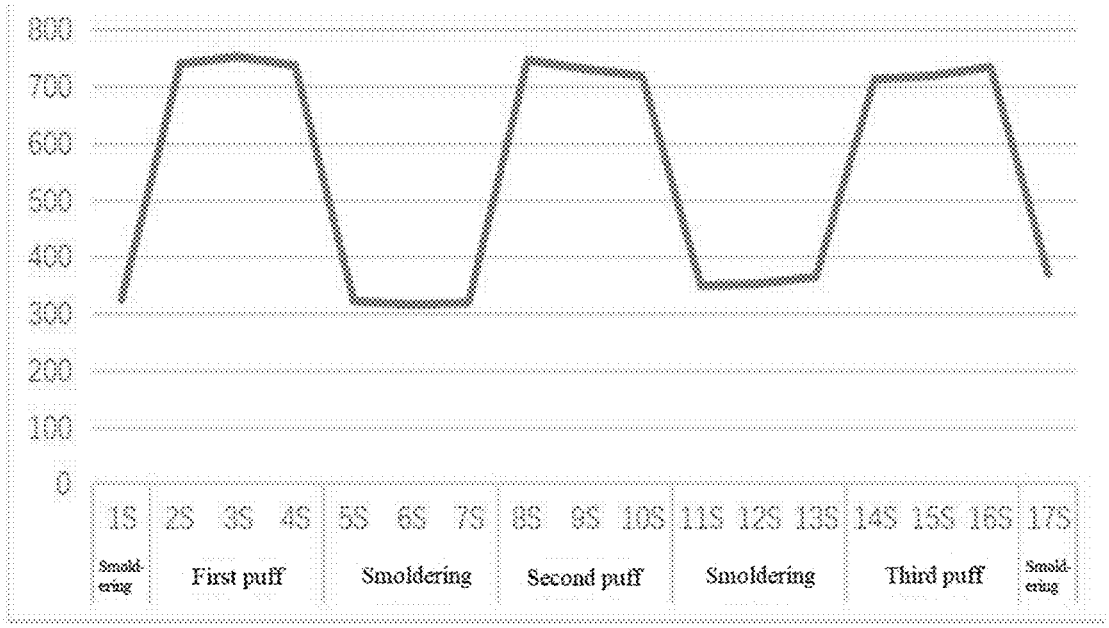
Figure 20:
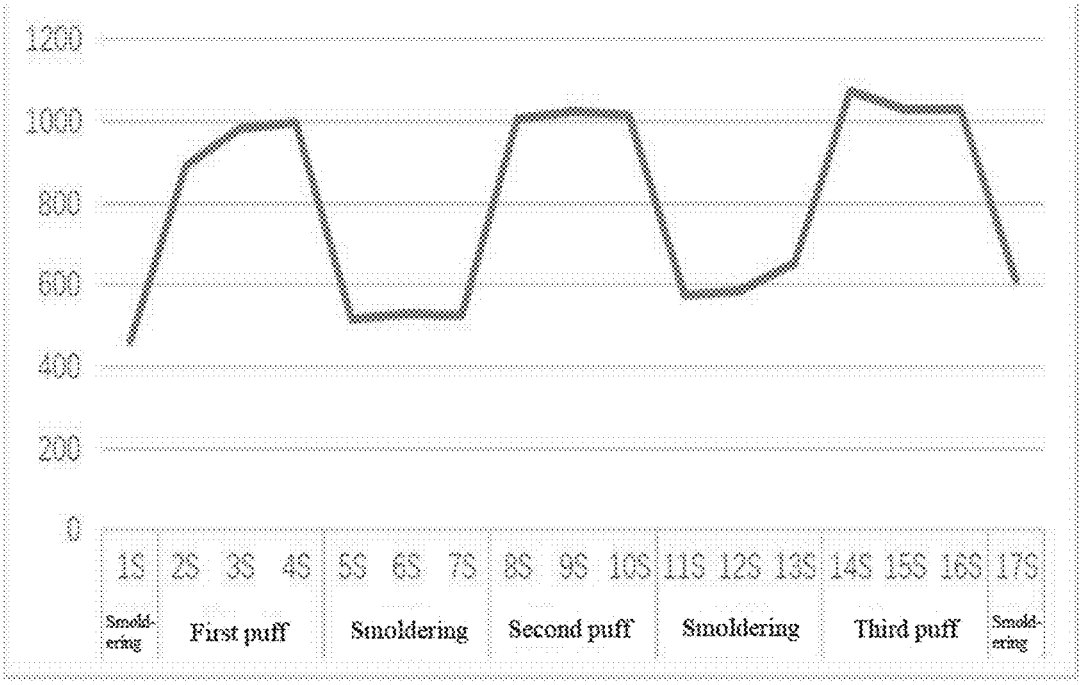
FIGS. 20-23 are the peak value change curves of the heat of the cigarettes in control groups 1-4 during the suction process, wherein the heat is expressed as temperature in unit of ° C.
Figure 21:
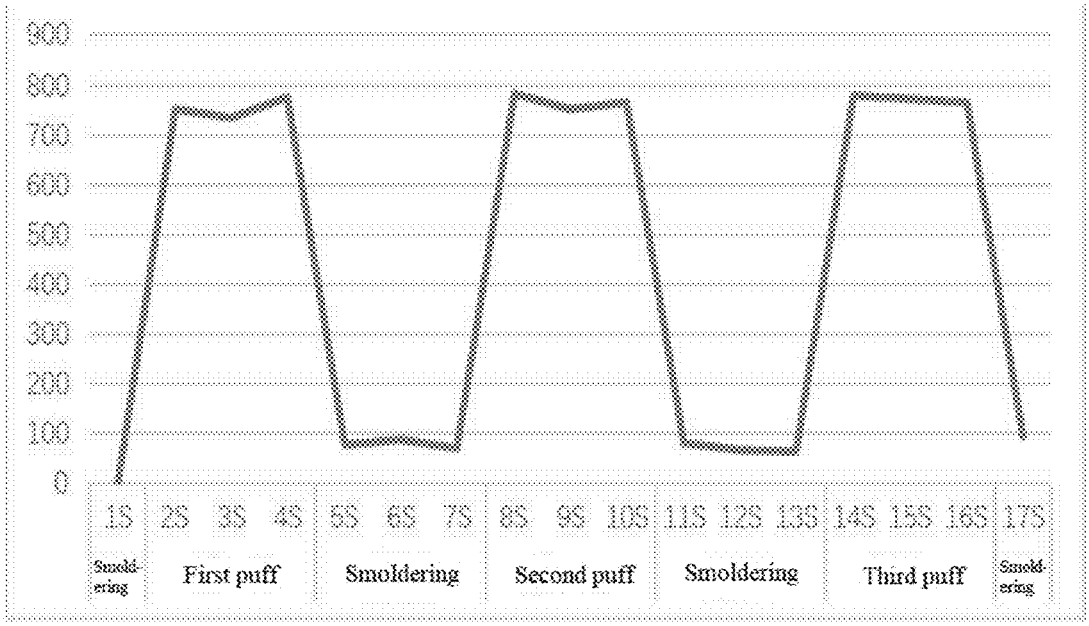
Figure 22:
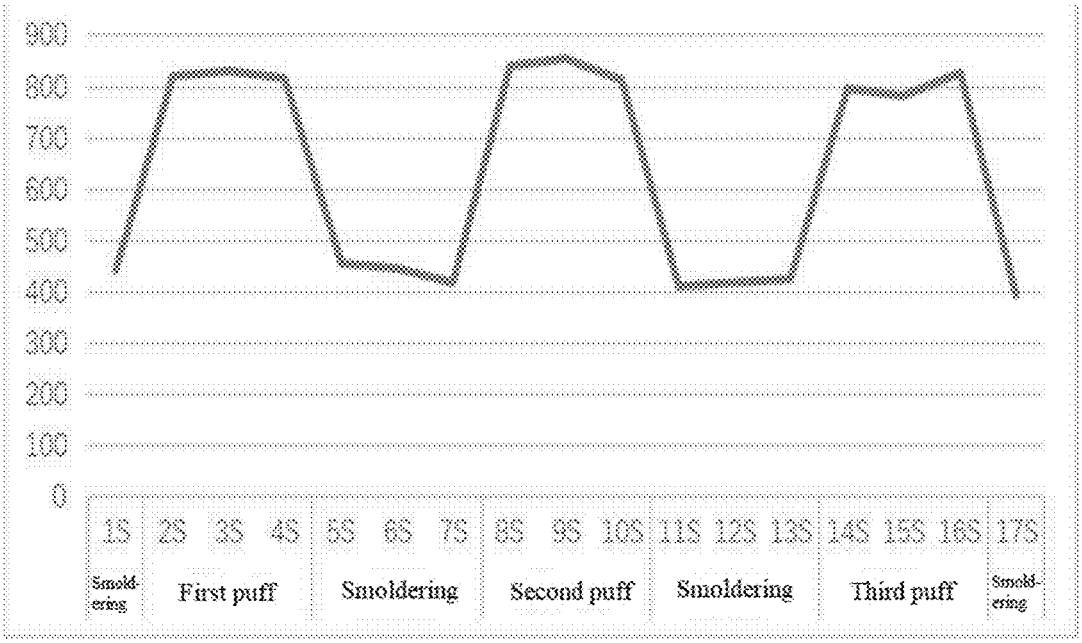
Figure 23:
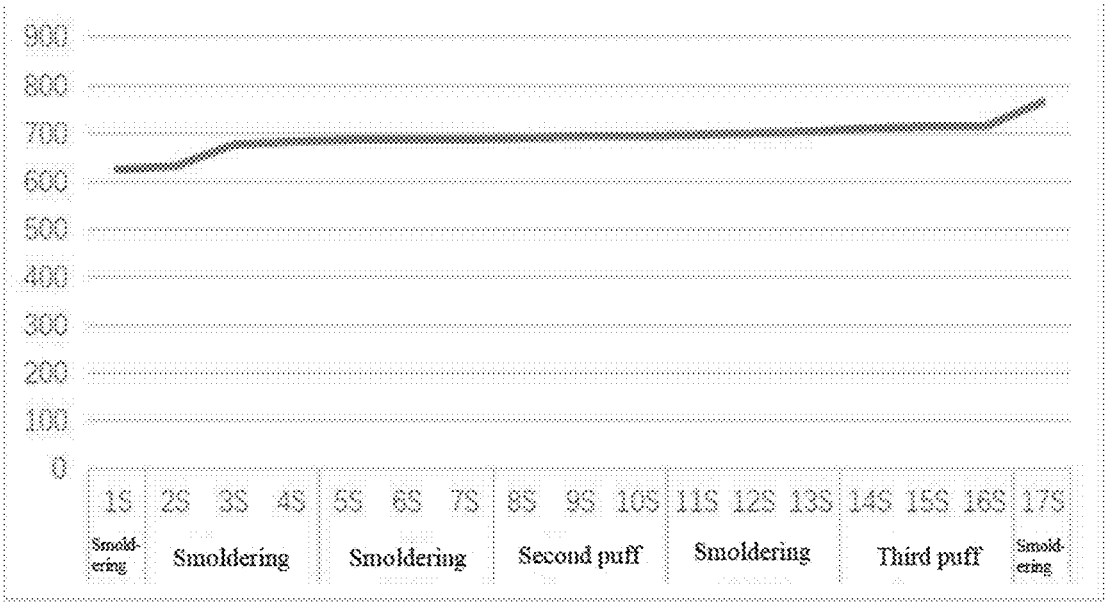
Figure 24A:
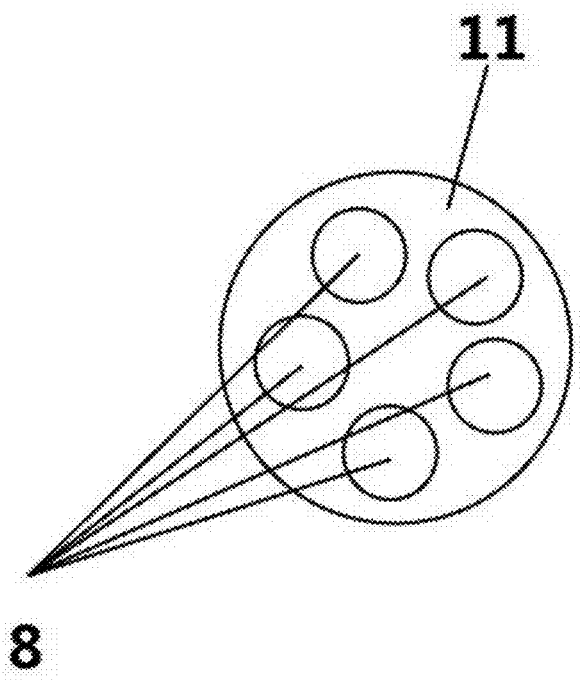
FIG. 24A is a schematic diagram showing the cross section of the cigarette including a plurality of tobacco units according to the present invention.
Figure 24B:
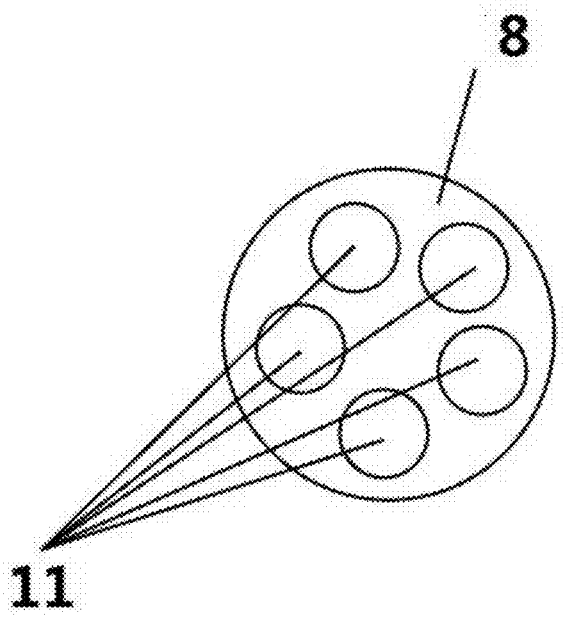
FIG. 24B is a schematic diagram showing the cross section of the cigarette including a plurality of heat source units according to the present invention.

During the suction process, the temperatures of tobacco in the samples of the above embodiments and control groups in different time periods are detected and recorded to characterize and compare the change in the peak value of heat. The results are shown in FIGS. 17-23.

Conclusion: from FIGS. 17-23, it can be concluded that the cigarettes in embodiment 1, embodiment 2 and embodiment 3 of the present invention can be adapted to the puff-by-puff suction mode, which increases the temperature of tobacco and leads to better consumption experience, and the effects are similar to those of control group 1, control group 2 and control group 3. The cigarette in control group 4 continues to raise the temperature of the tobacco in an uncontrolled way and accordingly causes the great waste of fuel material, at the same time, it cannot be adapted to the puff-by-puff suction mode, causing a poor consumption experience and a bleak application prospect.

The above is only specific embodiments of the present invention, but the protection scope of the present invention is not limited to these specific embodiments. Any change or replacement made by those skilled in the art within the technical scope of the present invention shall fall within the scope of protection of the present invention. Therefore, the scope of protection of the present invention shall be based on the scope of protection of the claims.

What is claimed is:

1. A disposable double-channel cigarette, comprising:

a tobacco unit, wherein the tobacco unit comprises a tobacco unit channel, a suction end and an ignition end; and a heat source unit, wherein the heat source unit comprises a heat source unit channel;

wherein, an axis of the tobacco unit channel and an axis of the heat source unit channel are arranged in parallel, and an air-tight heat conduction layer is arranged at a contact portion between the tobacco unit channel and the heat source unit channel, extends an entire length of the heat source unit channel, and prevents fluid flow between the tobacco unit channel and the heat source unit channel; a pneumatic device and a tobacco component are arranged in the tobacco unit channel; an air extraction device and a fuel component are arranged in the heat source unit channel;

a linkage device is arranged between the pneumatic device and the air extraction device, and the linkage device transfers power between the pneumatic device and the air extraction device.

2. The disposable double-channel cigarette of claim 1, wherein, the tobacco unit is at least partially inserted into the heat source unit, or the heat source unit is at least partially inserted into the tobacco unit, or the tobacco unit and the heat source unit are juxtaposed and at least partially in contact with each other; wherein, a quantity of the tobacco unit is at least one, and a quantity of the heat source unit is at least one.

3. The disposable double-channel cigarette of claim 2, wherein, the ignition end of the tobacco unit is provided with a detachable permeable flame retardant element.

4. The disposable double-channel cigarette of claim 2, wherein, the pneumatic device is a first fan or a first turbine, and the air extraction device is a second fan or a second turbine; wherein, the pneumatic device and the air extraction device are arranged independently of each other.

5. The disposable double-channel cigarette of claim 2, wherein, the linkage device is a magnetic linkage device or a mechanical linkage device.

6. The disposable double-channel cigarette of claim 2, wherein, the pneumatic device and the air extraction device are arranged at the suction end of the tobacco unit.

7. The disposable double-channel cigarette of claim 2, wherein, the heat source unit channel is provided with a burnt waste gas outlet downstream of the air extraction device.

8. The disposable double-channel cigarette of claim 2, further comprising a filter unit, wherein the filter unit comprises a filter unit channel, and the filter unit comprising the filter unit channel is arranged at the suction end of the tobacco unit.

9. The disposable double-channel cigarette of claim 1, wherein, the ignition end of the tobacco unit is provided with a detachable permeable flame retardant element.

10. The disposable double-channel cigarette of claim 9, wherein the detachable permeable flame retardant element is a granular substance or a porous substance.

11. The disposable double-channel cigarette of claim 9, wherein the detachable permeable flame retardant element is an extruded clay particle.

12. The disposable double-channel cigarette of claim 1, wherein, the pneumatic device is a first fan or a first turbine, and the air extraction device is a second fan or a second turbine; wherein, the pneumatic device and the air extraction device are arranged independently of each other.

13. The disposable double-channel cigarette of claim 1, wherein, the linkage device is a magnetic linkage device or a mechanical linkage device.

14. The disposable double-channel cigarette of claim 13, wherein two parts of the linkage device are a first linkage device and a second linkage device, wherein the first linkage device is located in the tobacco unit channel and the second linkage device is located in the heat source unit channel;

the first linkage device is arranged on the pneumatic device in the tobacco unit channel; and the second linkage device is arranged on the air extraction device in the heat source unit channel.

15. The disposable double-channel cigarette of claim 1, wherein, the pneumatic device and the air extraction device are arranged at the suction end of the tobacco unit.

16. The disposable double-channel cigarette of claim 1, wherein, the heat source unit channel is provided with a burnt waste gas outlet downstream of the air extraction device.

17. The disposable double-channel cigarette of claim 1, further comprising a filter unit, wherein the filter unit comprises a filter unit channel, and the filter unit comprising the filter unit channel is arranged at the suction end of the tobacco unit.

18. A method for preparing the disposable double-channel cigarette of claim 1, comprising the following steps:

step A, preparing the tobacco unit, wherein the tobacco unit comprises the tobacco unit channel, the pneumatic device and the tobacco component;

step B, preparing the heat source unit, wherein the heat source unit comprises the heat source unit channel, the air extraction device and the fuel component; and step C, assembling the tobacco unit prepared in step A with the heat source unit prepared in step B to obtain the disposable double-channel cigarette; wherein the pneumatic device and the air extraction device are connected by the linkage device in a power transfer manner; the axis of the tobacco unit channel and the axis of the heat source unit channel are arranged in parallel, and the air-tight heat conduction layer is arranged at the contact portion between the tobacco unit channel and the heat source unit channel, extends the entire length of the heat source unit channel, and prevents the fluid flow between the tobacco unit channel and the heat source unit channel, and the linkage device is prepared during, before or after a preparation of the tobacco unit and the heat source unit.

19. The method of claim 18, further comprising the following step:

step D, preparing a filter unit, wherein the filter unit comprises a filter unit channel, the filter unit is arranged at the suction end of the tobacco unit, and step C is performed before or after step D.

* * * * *